US012385479B2

(12) United States Patent
Kumar et al.

(10) Patent No.: US 12,385,479 B2
(45) Date of Patent: Aug. 12, 2025

(54) PUMPING SYSTEM HAVING REMOTE VALVE BLOCKS

(71) Applicant: SPM Oil & Gas Inc., Fort Worth, TX (US)

(72) Inventors: Chandu Kumar, Fort Worth, TX (US); John McCrady, Burleson, TX (US); Joe Allen Sutton, Weatherford, TX (US); Wesley P. Clark, Weatherford, TX (US); Richard David Peer, Tomball, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 168 days.

(21) Appl. No.: 17/996,047

(22) PCT Filed: Apr. 12, 2021

(86) PCT No.: PCT/US2021/026898

§ 371 (c)(1),
(2) Date: Oct. 12, 2022

(87) PCT Pub. No.: WO2021/211463

PCT Pub. Date: Oct. 21, 2021

(65) Prior Publication Data

US 2023/0184238 A1 Jun. 15, 2023

Related U.S. Application Data

(60) Provisional application No. 63/009,348, filed on Apr. 13, 2020.

(51) Int. Cl.
*F04B 43/067* (2006.01)
*E21B 43/26* (2006.01)
(Continued)

(52) U.S. Cl.
CPC ..... *F04B 43/067* (2013.01); *E21B 43/26* (2013.01); *F04B 47/04* (2013.01); *F04B 49/03* (2013.01)

(58) Field of Classification Search
CPC ..... F04B 43/06–0736; F04B 47/04; F04B 49/03; F04B 15/02; F04B 19/003; F04B 47/12; E21B 43/26
(Continued)

(56) References Cited

U.S. PATENT DOCUMENTS 2,867,242 A * 1/1959 Harris ..... F16L 27/111 285/422
4,406,595 A * 9/1983 Robertson ..... F04B 43/067 91/313
(Continued)

FOREIGN PATENT DOCUMENTS

EP 2913525 A1 * 9/2015 ..... F04B 1/02
WO WO-2019007774 A1 * 1/2019 ..... E21B 43/26
WO WO-2019007775 A1 * 1/2019 ..... E21B 43/26

OTHER PUBLICATIONS

International Search Report and Written Opinion issued in Application No. PCT/US2021/026898; Dated Jul. 16, 2021, 8 Pages.

*Primary Examiner* — Alexander B Comley

(57) ABSTRACT

This disclosure presents a pumping system that includes a plunger disposed in a pressure cylinder that is operable to be displaced in a suction and a discharge stroke. A packing seal is disposed between the plunger and the pressure cylinder. A valve block is disposed separate from the pressure cylinder and houses a suction valve and a discharge valve. A conduit fluidly couples the pressure cylinder with the valve block.

20 Claims, 3 Drawing Sheets

(51) Int. Cl.
*F04B 47/04* (2006.01)
*F04B 49/03* (2006.01)

(58) Field of Classification Search
USPC ..... 417/383–389
See application file for complete search history.

(56) References Cited

U.S. PATENT DOCUMENTS 4,439,112 A * 3/1984 Kitsnik ..... F04B 43/10 91/275
4,611,973 A * 9/1986 Birdwell ..... F04B 53/125 417/342
4,648,810 A * 3/1987 Schippers ..... F04B 43/073 91/313
5,059,101 A * 10/1991 Valavaara ..... F04B 53/109 417/539
6,733,252 B2 * 5/2004 Feygin ..... B67D 7/62 417/478
8,047,814 B2 * 11/2011 Yajima ..... F04B 43/107 417/385
8,388,321 B2 * 3/2013 Wilmsen ..... F04B 17/03 92/96
9,534,691 B2 * 1/2017 Miller ..... F16J 15/166
2013/0017101 A1 * 1/2013 Ferk ..... F04B 43/026 417/386
2015/0136418 A1 * 5/2015 Garrett ..... E21B 43/127 166/378
2016/0177945 A1 * 6/2016 Byrne ..... F04B 1/0404 184/6
2017/0009761 A1 * 1/2017 Bilousov ..... F04B 43/113
2018/0298731 A1 * 10/2018 Bishop ..... H02J 3/381

* cited by examiner

PUMPING SYSTEM HAVING REMOTE VALVE BLOCKS

PRIORITY CLAIM

This application is a 371 national stage application of PCT Application No. PCT/US2021/026898 filed on Apr. 12, 2021, entitled "PUMPING SYSTEM HAVING REMOTE VALVE BLOCKS," which claims priority to U.S. Provisional Application for Patent No. 63/009,348 filed on Apr. 13, 2020 the disclosures of the prior Applications are considered part of and are incorporated by reference into this Patent Application.

FIELD

This disclosure relates in general to pumping systems used in oilfield applications, such as hydraulic fracturing, and more particularly to positive displacement pumping systems with remote valve blocks that are separate from a pressure cylinder.

BACKGROUND

Large pumps are commonly used for mining and oilfield applications, such as, for example, hydraulic fracturing. During hydraulic fracturing, fracturing fluid (i.e., cement, mud, frac sand and other material) is pumped at high pressures into a wellbore to cause the producing formation to fracture. One commonly used pump in hydraulic fracturing is a high pressure reciprocating pump, like the SPM® Destiny™ TWS 2500 frac pump or the SPM® QEM 3000 Continuous Duty Frac Pump, manufactured by S.P.M. Flow Control, Inc. of Fort Worth, Texas In operation, the fracturing fluid flows into and out of a pump fluid chamber as a result of one or more reciprocating piston-like plungers moving away from and toward the fluid chamber. As the plunger moves away from the fluid chamber, the pressure inside the chamber decreases, creating a differential pressure across an inlet valve, drawing the fracturing fluid through the inlet valve into the chamber. When the plunger changes direction and begins to move towards the fluid chamber, the pressure inside the chamber substantially increases closing the inlet valve increasing the differential pressure across an outlet valve and opening the outlet valve, enabling the highly pressurized fracturing fluid to discharge through the outlet valve into the wellbore.

A typical frac unit is powered with a diesel engine driving a frac pump through a multispeed transmission. The rotational energy transferred to the reciprocating frac pump is channeled to horizontal plungers for pumping via a crankshaft and connecting rods. The operating conditions are often extreme involving high fluid flow and high operating pressures (oftentimes up to 15,000 psi).

In conventional pumps used in hydraulic fracturing operations, suction and discharge valves are integrated into the fluid chambers that are mounted to the pump power end. The suction and discharge valves are integrated into a fluid end of conventional linear and reciprocating pumps. Conventional linear pumps (also known as hydraulic intensifiers) and conventional reciprocating pumps include suction and discharge valves proximate their pressure cylinders. This integration results in complex designs and limited design freedom for the overall package size and configuration of conventional pumps. Also, the fluid chambers of conventional fracking pumps are difficult to machine and manufacturer, and the fluid chambers with integrated suction and discharge valves are subjected to high stresses and multiple stress risers. In reciprocating hydraulic fracturing pumps there is a high risk of early cyclic fatigue failure.

Conventional hydraulic fracturing pumps are expensive to fabricate in material and labor, and they are heavy and bulky. They also require frequent valve and valve seat replacements, so they can be difficult and expensive to maintain. Moreover, conventional pumps with integrated suction and discharge valves may also present challenges in servicing the valves because a ladder or service platform may be required to access the suction and discharge valves to perform service.

Conventional reciprocating hydraulic fracturing pumps include plunger packings. Plunger packings form a seal around the reciprocating plunger and are also referred to as seals. Conventional plunger packings in reciprocating pumps and linear hydraulic fracturing pumps operate in a slurry of sand and water, which can damage the seals and reduce the useful life of the plunger packings. The slurry is also abrasive and causes the plunger to wear. In certain applications, the plungers are hard-coated to reduce wear, but the hard coating can wear the packing seals.

With respect to conventional linear pumps used in hydraulic fracturing applications, the pumping is typically performed using multiple axes. Using multiple axes reduces the long dwell time in order to maintain the consistency of the slurry in the suction manifold. In other words, to prevent the sand particles from separating from the liquid of the slurry (to avoid the sand falling out of suspension), conventional linear pumps cluster the suction and discharge ports together such that they serve multiple axes at the same time and thereby lower the dwell time to be equal to the stroke time divided by the number of axes. These constraints limit the design and application flexibility of linear pumps when used in a slurry application, such as for hydraulic fracturing.

SUMMARY

This disclosure presents a pumping system that includes a plunger disposed in a pressure cylinder that is operable to be displaced in a suction and a discharge stroke. A packing seal is disposed between the plunger and the pressure cylinder. A valve block is disposed separate from the pressure cylinder and houses a suction valve and a discharge valve. A conduit fluidly couples the pressure cylinder with the valve block.

The pumping system of the present disclosure may be used with a working fluid, for example a fracking fluid or a slurry, that is commonly used in hydraulic fracturing or other oilfield operations.

According to certain embodiments, a barrier fluid protects the packing seals in the fluid cylinder that would otherwise be exposed to the harsh slurry.

Technical advantages of the present disclosure include reduced design complexity for the overall design of the pumping system. Also, by remotely locating the valve block that houses the suction and discharge valves, greater freedom of design and freedom of package size and configurations are enabled. The pumping system fluid end according to the disclosed embodiments is also easier to machine and manufacture than conventional reciprocating or linear pumps.

In a linear actuated pump embodiment, the longer pump stroke reduces the risk of early cyclic fatigue failure of certain pump components. The fluid cylinder for the linear pumping system is less expensive in material and labor to manufacture. It may also be designed to be lighter and have a smaller profile than conventional reciprocating or linear pumps. Also, a stress induced fracture in a conventional fluid end renders the whole fluid end inoperable resulting in the loss of 2 to 4 other cylinders.

An additional technical advantage is that the valves and seats are more easily and conveniently located, which makes valve and seat replacement easier.

Using a single conduit to plumb the slurry from the remote valve block to the pressure cylinder allows a linear pump according to the teachings of the present disclosure to operate without clustered suction and discharge ports. It also eliminates the concern of sand falling out of suspension in the slurry because there is no dwell time for the slurry in a single axis linear pump. The slurry is in constant motion. It is sucked in to the system, and once it is fully sucked in the discharge stroke forces the slurry out of the system and into the wellbore.

The pressure cylinders may be designed without accommodating valves and seats, which simplifies the design of the pressure cylinder. Also with a smaller and lighter pressure cylinder, the cantilevered weight on the pump frame can be significantly reduced.

Other aspects, features, and advantages will become apparent from the following detailed description when taken in conjunction with the accompanying drawings, which are a part of this disclosure and which illustrate, by way of example, principles of the inventions hereof.

DESCRIPTION OF THE FIGURES

The accompanying drawings facilitate an understanding of the various embodiments.

Like numerals refer to like elements.

DETAILED DESCRIPTION

Figure 1A:
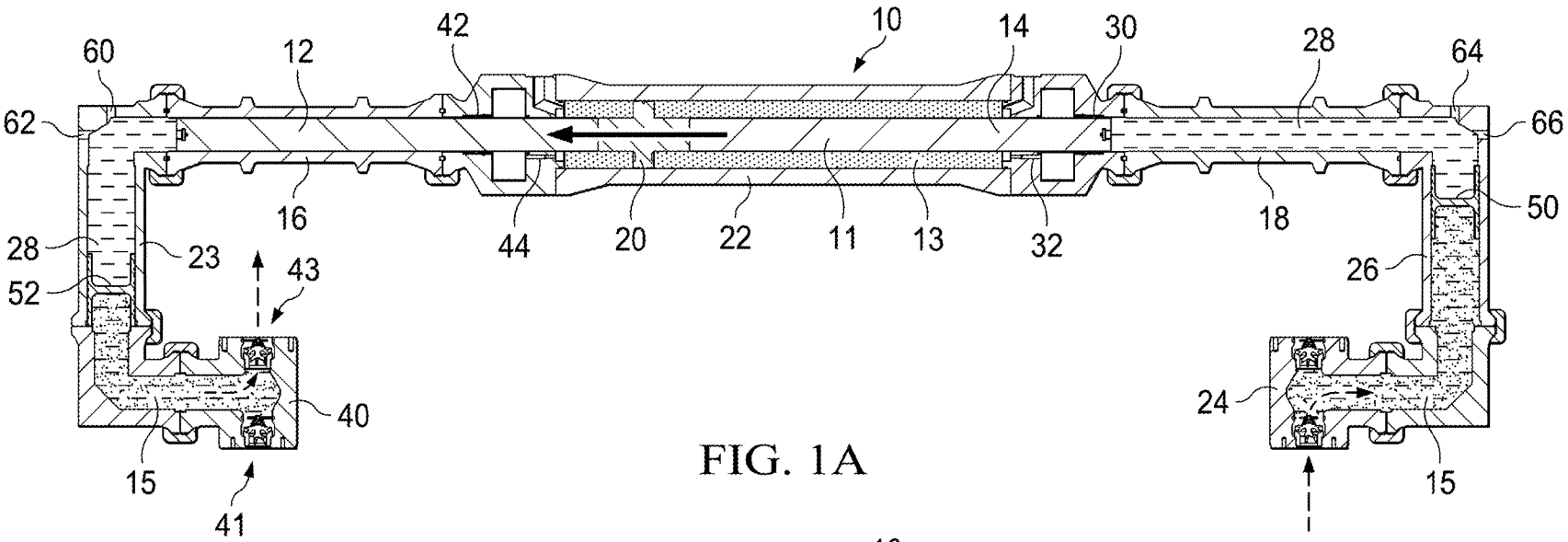
FIGS. 1A and 1B are schematics of a cross-section of a linear pump with remote valve blocks housing suction and discharge valves according to the teachings of the present disclosure.

This disclosure presents embodiments of pumping systems suitable to be employed in hydraulic fracturing applications. According to one embodiment, the pumping systems may include a reciprocating pump with remote valve blocks that house suction and discharge valves. A working fluid is sucked into a suction valve and discharged at a high fluid pressure through the discharge valve. A remote valve block is disposed separate from a pressure cylinder. A conduit fluidly couples the remote valve block with a pressure cylinder.

According to another embodiment, a pumping system includes a linear pump that operates in a single axis and a remote valve block that houses suction and discharge valves. Other axes could be employed in parallel in a similar manner to make a multi-axis pumping unit. Also, embodiments disclosed herein are shown and described with respect to a double acting linear pump (where motion of the plunger pumps both sides of a hydraulic shell), but the teachings of the present disclosure are also applicable to a single acting linear pump (motion of the plunger pumps on one side of the hydraulic shell).

According to certain embodiments, the pump moves a clean barrier fluid (also referred to herein as a clean fluid) through the conduits. The clean barrier fluid is moved through the pressure cylinders of either a linear or a reciprocating pump. According to one embodiment, the clean barrier fluid moves through conduits that fluidly couple a cylinder block of a reciprocating pump to one or more remote valve blocks. In either the linear pump or the reciprocating pump embodiments, packing seals that conventionally would be exposed to harsh working fluid, such as a hydraulic fracturing fluid, are instead exposed to a clean barrier fluid, such as water. According to an alternate embodiment, the packing seals are disposed in a pressure cylinder and are isolated from the harsh working fluid. Because the seals do not operate in the harsh environment of the fracking fluid, they will wear less and last longer.

A valve block that houses suction and discharge valves is disposed remote from the pump and is fluidly connected to the pump through a conduit or line. Remotely locating the suction and discharge valves allows easier access to the valves and relieves design constraints associated with the footprint of the pump mechanism. Also, the remote suction and discharge valves may be incorporated into a manifold, which offers greater design flexibility and easier access for replacement or repair.

According to the teachings of the present disclosure, the suction and discharge valves associated with the pressure cylinders of reciprocating and linear pumps are not integrated with the respective pressure cylinders. Rather, the suction and discharge valves associated with each pressure cylinder are disposed separate from and remote with respect its respective pressure cylinder.

Among other advantages, by locating the suction and discharge valves remotely, the length of a linear pump can be reduced because the overall length does not include the suction and discharge valves positioned at each end of the pressure cylinders. Also, in order to avoid the solid particles falling out of the slurry mix during longer suction and discharge strokes of the plungers in a linear pumping system, each valve block may be fluidly coupled to its respective pressure cylinder by a single conduit. Thus, there is no dwell time, as is common with multiple pumping axes employed in conventional linear pumping systems. Dwell occurs in the suction and discharge lines of linear pumps. The fluid in the suction line feeding one end of a conventional linear pump must stop and wait for the previous suction stroke to be discharged. Likewise, frac fluid in the discharge line must stop and wait for the next discharge stroke while the suction stroke is active.

In contrast, according to the teachings of the present disclosure, the working fluid drawn in by the linear pumping system according to the teachings of the present disclosure is in constant motion—it is discharged as soon as it is fully sucked into the system.

Figure 1B:
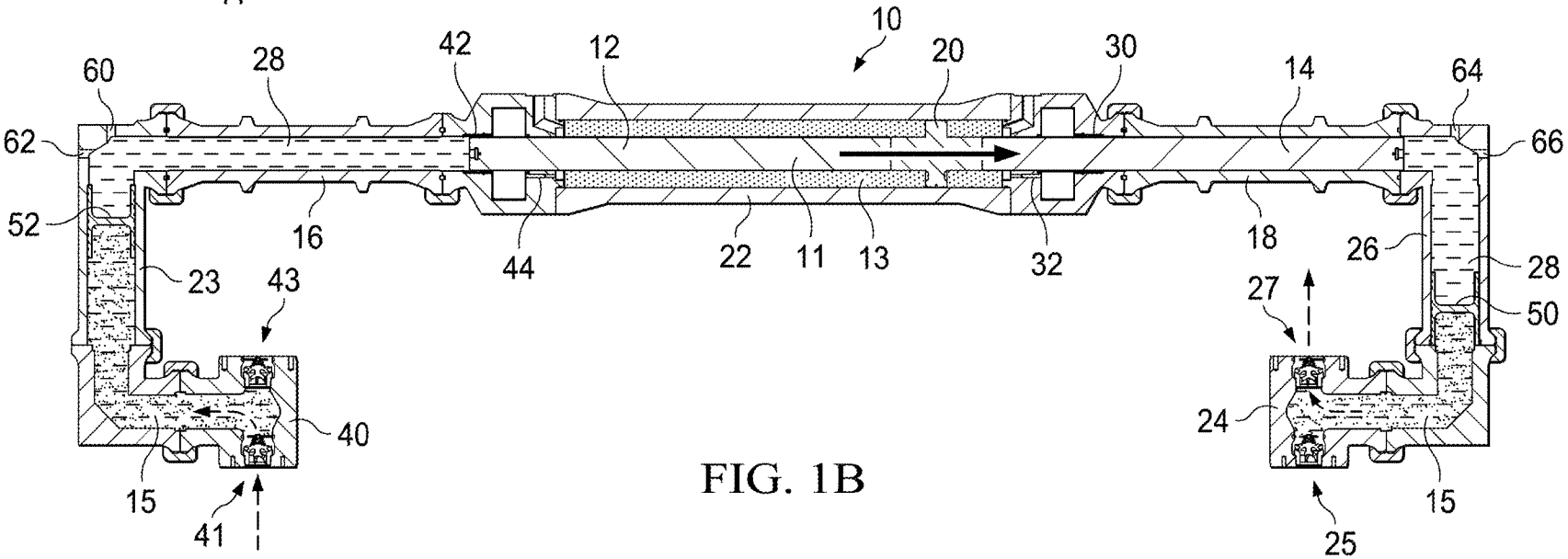

FIGS. 1A and 1B are cross-sections of a linear pumping system 10 according to the teachings of the present disclosure. The linear pumping system 10 employs remote suction and discharge valves that are connected to their respective pressure cylinders by a single conduit. A plunger 11 moves within a pressure cylinder to create suction and discharge pressure. The plunger 11 includes a first plunger portion 12 and a second plunger portion 14. The first plunger portion 12 moves through a first pressure cylinder 16, and the second plunger portion 14 moves through a second pressure cylinder 18. The depicted embodiment shows the first plunger portion 12 and the second plunger portion 14 moving through a hydraulic fluid and through the fluid disposed in the pressure cylinder 16, 18. This disclosure also contemplates longer plunger portions 12, 14 that do not operate in the hydraulic fluid.

The plunger 11 may be a single part integrating the first plunger portion 12 and the second plunger portion 14. According to an alternate embodiment, each of the plunger portions 12 and 14 may be separate parts that are joined using any suitable connector to form the plunger 11. The plunger 11 is powered by hydraulic pumps driven by a prime mover, such as a diesel engine or an electric motor. The prime mover pumps hydraulic fluid 13 to circulate it within a hydraulic shell 22. The illustrated drive force for the linear pumping system 10 is hydraulic. However, an electrical drive may be used in lieu of the hydraulic force.

An increased diameter portion 20 extends radially from the plunger 11 and is acted on by the hydraulic fluid 13, for example a hydraulic oil. According to known hydraulic power transmission principles, the hydraulic fluid 13 intensifies and increases the pressure with which the plunger 11 delivers a working fluid 15 to a wellbore. For example, in certain embodiments the hydraulic fluid 13 acting on such an increased diameter portion 20 can multiply a hydraulic oil pressure of 5000 psi to create a wellbore pressure of 15,000 psi.

FIG. 1A shows the first plunger portion 12 in a compression stroke and simultaneously the second plunger portion 14 is in a suction stroke. FIG. 1B shows the first plunger portion 12 in a suction stroke and the second plunger portion 14 in a discharge stroke. As shown in FIG. 1A, the working fluid 15, such as a frac fluid, is drawn through a remote valve block 24 and into a working fluid conduit 26. The remote valve block 24 houses a suction valve 25 and a discharge valve 27. The working fluid conduit 26 generally extends from the pressure cylinder 18 to the remote valve block 24.

The working fluid 15 is drawn through the suction valve 25 and discharged through the discharge valve 27 corresponding to the suction and compression motion of the plunger portion 14. Each of the suction valve 25 and discharge valve 27 are check valves that only permit fluid flow in one direction. Thus, when fluid is flowing through the suction valve 25, the discharge valve 27 is closed. Similarly, when fluid is flowing through the discharge valve 27, the suction valve 25 is closed.

In the double-acting linear pumping system 10 illustrated, the pressure cylinder 16 depicted on the left side of the pumping system 10 is also fluidly coupled to a remote valve block 40. The working fluid 15, such as a frac fluid, is drawn through the remote valve block 40 and into a working fluid conduit 23. The remote valve block 40 houses a suction valve 41 and a discharge valve 43. The working fluid conduit 23 generally extends from the pressure cylinder 16 to the remote valve block 40. The working fluid 15 is drawn through the suction valve 41 and discharged through the discharge valve 43 corresponding to the suction and compression motion of the plunger portion 12. Each of the suction valve 41 and discharge valve 43 are check valves that only permit fluid flow in one direction. Thus, when fluid is flowing through the suction valve 41, the discharge valve 43 is closed. Similarly, when fluid is flowing through the discharge valve 43, the suction valve 41 is closed.

According to certain embodiments, a clean barrier fluid 28 is disposed in either one or both of the working fluid conduits 23 and 26. For example, the barrier fluid 28 disposed in the working fluid conduit 26 separates the working fluid 15 from the pressure cylinder 18. Alternatively, the linear pumping system 10 may be operated without the barrier fluid 28. With the barrier fluid 28 disposed between the working fluid 15 and the pressure cylinder 18, the pressure cylinder 18 and the second plunger portion 14 are not operating in a harsh working fluid. Rather, the second plunger portion 14 compresses the clean barrier fluid 28 that is disposed in the second pressure cylinder 18. This allows flexibility in the design of the plunger 11 and the pressure cylinder 18 because these components are not be required to withstand the abrasive working fluid 15, for example fracking fluid. When barrier fluid 28 is disposed in the working fluid conduit 23, the plunger portion 12 and the pressure cylinder 16 are protected from the abrasive working fluid 15 and operate in the clean barrier fluid 28.

With continuing reference to FIG. 1A, the linear pumping system 10 includes annular seal assemblies (also referred to as plunger packers) that surround the plunger 11 and form a fluid-tight seal between the plunger portion and the corresponding pressure cylinder. The seal assemblies facilitate the stroke of the plunger without the fluid (frac fluid or clean barrier fluid) leaking between the plunger and the pressure cylinder. For example, an annular plunger packing seal assembly 30 is disposed within the pressure cylinder 18 and surrounds the plunger portion 14. Similarly, an annular plunger packing seal assembly 42 is disposed in the pressure cylinder 16 and surrounds the plunger portion 12. According to the teachings of the present disclosure, the seal assemblies 30 and 42 are isolated from the harsh working fluid 15. In certain embodiments, the seal assemblies 30 and 42 are primarily exposed to only the clean barrier fluid 28, which will allow the seal assemblies 30 and 42 to last longer than they otherwise would if they were constantly exposed to the harsh working fluid 15. Seal failure is a common issue in conventional frac pumps, so extending the working life of the packing seals 30, 42 according to the teachings of the present disclosure can be advantageous and also provide a motivation to improve other components of the pumping system to increase the working life of the overall pumping system.

An example of a packing seal assembly that may be used with the disclosed pumping systems including the linear pumping system 10 and the reciprocating pumping system 70 (see FIG. 2) is disclosed in U.S. Pat. No. 9,534,691 to Miller et al. and assigned to UTEX Industries, Inc., and hereby incorporated by reference.

The linear pumping system 10 also includes hydraulic fluid seals that are disposed within the hydraulic shell 22 and surround the plunger 11. The hydraulic fluid seals maintain the hydraulic fluid 13 within the hydraulic shell 22. The hydraulic fluid seals 32 may be a seal assembly with at least one elastomeric ring. The hydraulic fluid seals 32 surround the plunger 11 and form a fluid-tight seal between the plunger 11 and the hydraulic shell 22. The hydraulic seals 32 facilitate the stroke of the plunger without the hydraulic fluid 13 leaking between the plunger 11 and the hydraulic shell 22. For example, a hydraulic seal 32 is disposed within the hydraulic shell 22 and surrounds the plunger 11. Similarly, a hydraulic seal 44 is also disposed at an opposite side of the hydraulic shell 22 and surrounds the plunger 11. The hydraulic fluid seals 32 and 44 are exposed to the hydraulic fluid 13 in the hydraulic shell 22.

As shown in FIG. 1A, the motion of the plunger to the left simultaneously sucks working fluid 15 through the second remote valve block 24 and into the working fluid conduit 26. This plunger motion also draws the clean barrier fluid 28 into the pressure cylinder 18. In this position, the pump is prepared to discharge the working fluid 15 through the remote valve block 24 into the well when the prime mover drives the plunger 11 to the right as shown in FIG. 1B. FIG.

1B shows the right side of the linear pumping system 10 in its discharge position and the left side of the linear pumping system 10 in its suction position.

On the left side of the linear pumping system 10, the first plunger portion 12 advances through the first pressure cylinder 16 and creates a pressure to move the clean barrier fluid 28 that in turn applies pressure to the working fluid 15 to discharge the working fluid 15 at an elevated pressure, for example 15,000 psi through the remote valve block 40 into the wellbore. As discussed above, the remote valve block 40 includes a first suction valve 41 and a first discharge valve 43. Each of the first suction valve 41 and discharge valve 43 are check valves that only permit fluid flow in one direction. Thus, when fluid is flowing through the suction valve 41, the discharge valve 43 is closed. Similarly, when fluid is flowing through the discharge valve 43, the suction valve is closed 41.

With continuing reference to FIG. 1A, the linear pumping system 10 may include an isolator 50 disposed in the working fluid conduit 26. The isolator 50 moves freely within the working fluid conduit 26 with the flow of the working fluid 15 in the working fluid conduit 26. The isolator 50 separates the working fluid 15 from the clean barrier fluid 28. An isolator 52 is disposed in the working fluid conduit 23 to separate the working fluid 15 from the clean barrier fluid 28 that is driven by the first plunger portion 12. The isolator 50, 52 may also be referred to as a pig, a shuttle, a ball, or a cartridge. Devices similar to the isolator 50, 52 are used to clean the inside of pipes, for example an oil pipeline. According to an embodiment, the isolator 50, 52 includes a mid-portion separating two cup portions. The open end of each cup portion faces opposite the other cup portion, and the mid-portion forms a floor for each cup portion. Absolute separation by the isolators 50 and 52 may not be required because a small volume of the working fluid 15 mixing with the barrier fluid 28 may be tolerated. For example, the barrier fluid 28 may be flushed between fracking jobs or at other periodic intervals.

According to an alternate embodiment with reference to the right side of the pumping system shown in FIGS. 1A and 1B (with the same applying to the left side), the barrier fluid 28 may separate the pressure cylinder 18, the plunger portion 14, and the packing seals 30, without an isolator disposed in the working fluid conduit 26. In this embodiment, the working fluid 15 may gradually blend with the barrier fluid 28, but the pumping system 10 may be operated for periods of time such that the packing seals 30, plunger portion 14, and pressure cylinder 18 have limited exposure to the working fluid 15. For example, the pumping system 10 may be operated for approximately two hours without an isolator separating the barrier fluid 28 from the working fluid 15 in the working fluid conduit 26. After the period of operation, the barrier fluid 28 may be flushed from the system 10 and replaced with clean barrier fluid.

Alternatively, when the barrier fluid is not used, the isolator 52 may be omitted because there is no barrier fluid 28 to maintain separate from the working fluid 15.

According to an embodiment, the linear pumping system 10 is fluidly coupled to one or more cooling fluid circuits that are operable to cool the barrier fluid 28. The motion of the barrier fluid 28 in the pressure cylinders and the working fluid conduits 23, 26 will cause the temperature of the barrier fluid 28 to increase. A cooling inlet port 60 and a cooling outlet port 62 are formed in the working fluid conduit 23. According to an embodiment, the cooling inlet port 60 and the cooling outlet port 62 are disposed proximate a junction of the pressure cylinder 16 and the working fluid conduit 23. The cooling inlet port 60 and the cooling outlet port 62 are disposed upstream of the isolator 52, for example on the barrier fluid side of the isolator 52.

Similarly, in a double-acting linear pump, a cooling inlet port 64 and a cooling outlet port 66 are formed in the working fluid conduit 26. According to an embodiment, the cooling inlet port 64 and the cooling outlet port 66 are disposed proximate a junction of the pressure cylinder 18 and the working fluid conduit 26. The cooling inlet port 64 and the cooling outlet port 66 are disposed upstream of the isolator 50, for example on the barrier fluid side of the isolator 50. The barrier fluid 28 may be discharged through the cooling fluid outlet ports 62 and 66 due to the motion of the plunger 11. This barrier fluid 28 may be cycled through a respective fluid cooling circuit (not shown) that includes a radiator or other suitable fluid cooling device. The cooled barrier fluid 28 is received from the respective fluid cooling circuit by the linear pumping system 10 through the cooling fluid inlet ports 60 and 64. Communicating fluid to and from the cooling circuit may correspond to the suction stroke of the respective plunger portion 12 and 14.

According to certain embodiments, inlet and outlet valves are in fluid communication respectively with the cooling inlet port 60 and the cooling outlet port 62 such that barrier fluid is circulated through the cooling outlet port 62, through the cooling circuit, and received in the cooling inlet port 60 on the suction stroke of the plunger 12. Similarly, inlet and outlet valves are in fluid communication respectively with the cooling inlet port 64 and the cooling outlet port 66 such that the barrier fluid is circulated sequentially through the cooling outlet port 66, through the fluid cooling circuit, and then received by the cooling inlet port 64.

This valve arrangement allows the barrier fluid 28 to circulate through the cooling circuit at fluid pressures that are significantly lower than the discharge pressure of the working fluid 15 generated by the plunger portions 12 and 14 during their respective discharge strokes. Thus, the barrier fluid 28 flows through the cooling circuit at manageable pressures, as opposed to the high pressures that are generated with respect to discharge of the working fluid 15. As a result, the fluid cooling circuit may be designed to withstand lower fluid pressures. The valves fluidly coupling the cooling circuits to the linear pumping system 10 may be closed during the discharge stroke of the respective plunger portion 12, 14.

Figure 2:
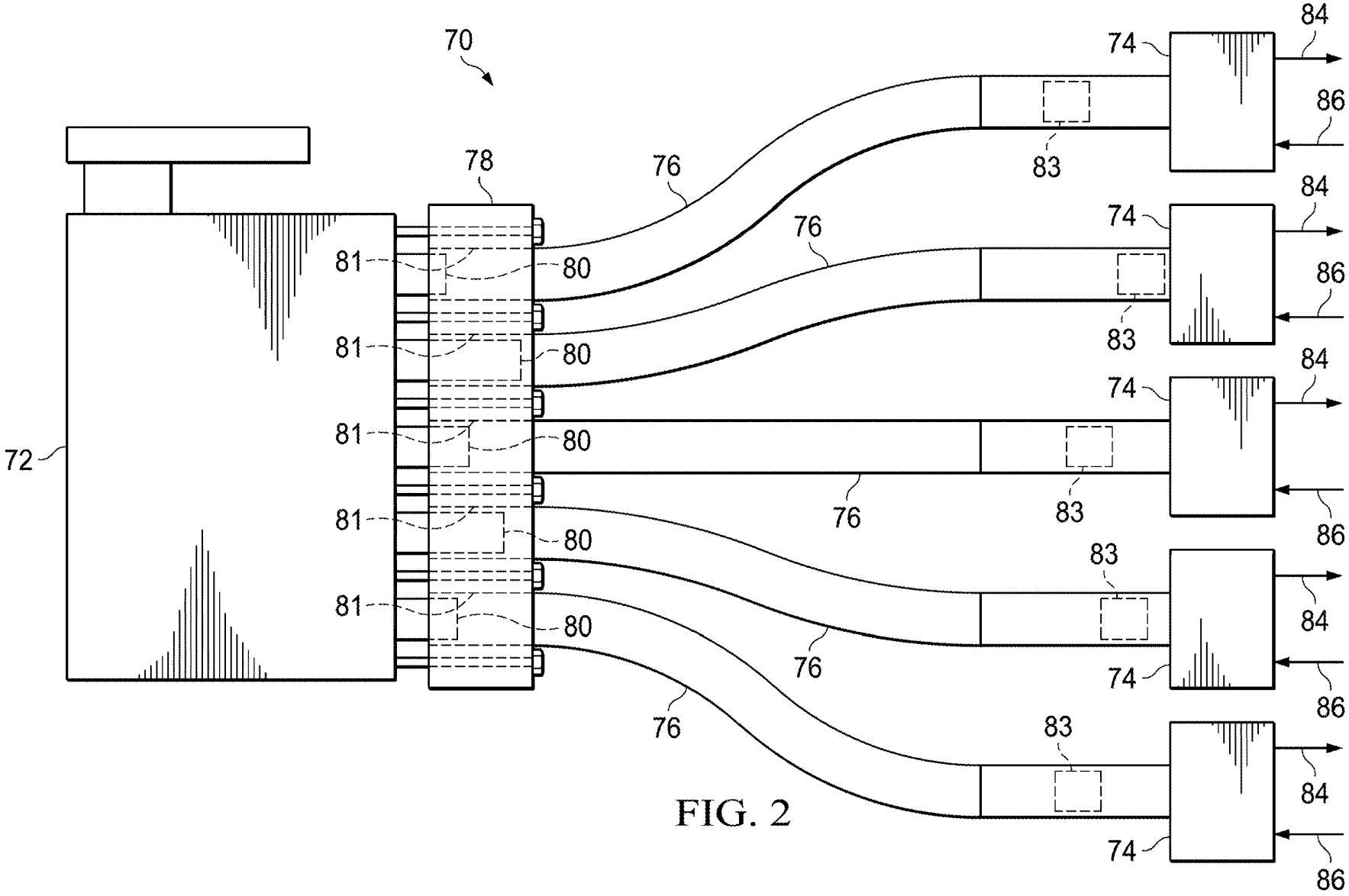
FIG. 2 is a schematic of a reciprocating pump with remote valve blocks housing suction and discharge valves.

Reference is made to FIG. 2, which is a schematic illustration of a reciprocating pumping system with remote valve blocks 74. The system 70 includes a reciprocating pump 72 in fluid communication with one or more remote valve blocks 74 through one or more working fluid conduits 76. The reciprocating pump 72 may be any reciprocating pump power end operable to inject a working fluid into a wellbore. According to one embodiment, the reciprocating pump 72 is the power end of a SPM® QEM 3000 Continuous Duty Frac Pump, manufactured by S.P.M. Flow Control, Inc. of Fort Worth, Texas with a simplified cylinder block 78. In one embodiment, a crankshaft within the reciprocating pump 72 is driven by a prime mover. The crankshaft is coupled to connecting rods that each in turn is coupled to a plunger 80. The plungers 80 reciprocate within respective pressure cylinders 81 that are formed in the cylinder block 78.

A remote valve block 74 is fluidly coupled to each pressure cylinder 81 and is disposed separate and remote from the pressure cylinder 81 and the plunger 80. As a result, the cylinder block 78 and each pressure cylinder 81 may be simplified. The simplified cylinder block 78 does not include suction and discharge valves that would otherwise be part of an integrated fluid end of a conventional reciprocating pump. According to certain embodiments, the cylinder block 78 also does not include a dedicated access port to allow servicing of the plunger 80. Also, the bore size of the pressure cylinders 81 formed in the cylinder block 78 may be increased, which may facilitate increased pumping pressure and/or pumping volume. According to certain embodiments of the cylinder block 78, the center-to-center limitation of pressure cylinders of conventional reciprocating pumps with integral valve blocks is reduced significantly because each pressure cylinder 81 does not have to accommodate suction and discharge valves.

A packing seal may be disposed in the pressure cylinder and surround the plunger 80. The packing seal may include the features and the function described above with respect to the packing seals 30 and 42 of the linear pumping system embodiment. According to an embodiment, the packing seals may be exposed to a clean barrier fluid, as described with respect to FIGS. 1A and 1B. The barrier fluid disposed in the pressure cylinders 81 and the working fluid conduits 76 separates the packing seals and the plungers 80 from the harsh working fluid. Thus, the packing seals and the plungers 80 will wear less and last longer.

Each pressure cylinder 81 is coupled to a working fluid conduit 76 that fluidly couples a respective pressure cylinder 81 with a remote valve block 74. The working fluid conduit 76 may be a flexible hose or a rigid pipe, or the working fluid conduit 76 may have portions that are flexible and portions that are rigid. The rigid pipe portions may accommodate the motion of an isolator 83. An isolator 83 may be disposed in each of the working fluid conduits 76. It may include the structure and function as described above with respect to FIGS. 1A and 1B. For example, the isolator 83 may move freely in the working fluid conduit 76 with the suction and the discharge of the working fluid. The isolator 83 separates the working fluid from the barrier fluid and a respective pressure cylinder 81, plunger 80, and packing seals (not shown). The remote valve blocks 74 may be easier to manufacture, transport, and service than conventional valve blocks that are integrated into a reciprocating pump. According to some embodiments, the remote valve blocks 74 may be supported by a trailer that is commonly found on fracturing job sites.

Each remote valve block 74 houses a suction valve represented by arrow 86 and a discharge valve represented by arrow 84. The remote valve block 74 may be supported by the ground or a trailer and may be supported independent of the reciprocating pump 72.

Figure 3A:
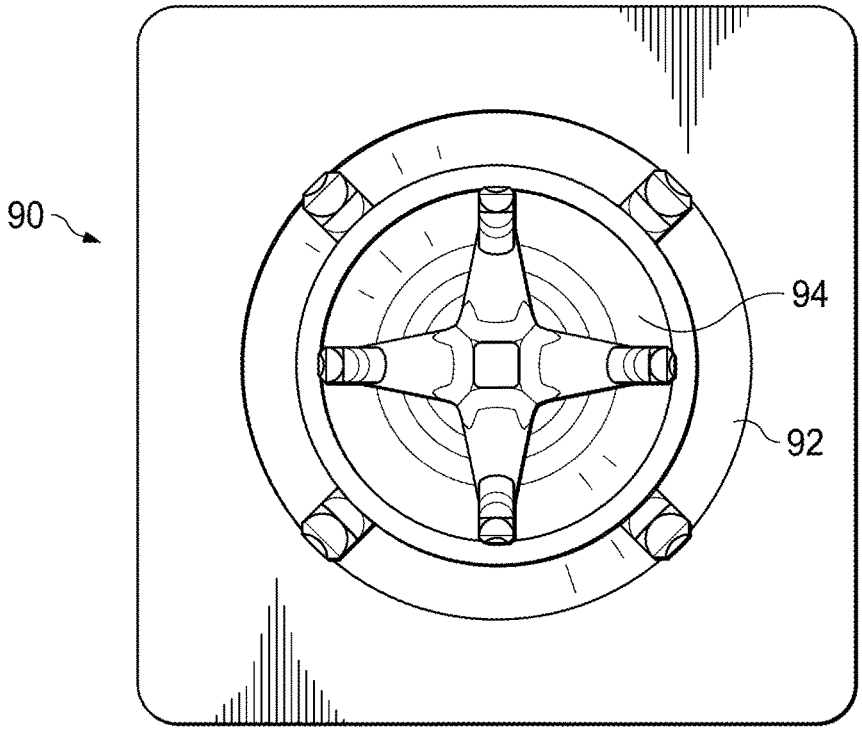
FIGS. 3A and 3B are schematics of remote valve blocks housing suction and discharge valves for a working fluid.
Figure 3B:
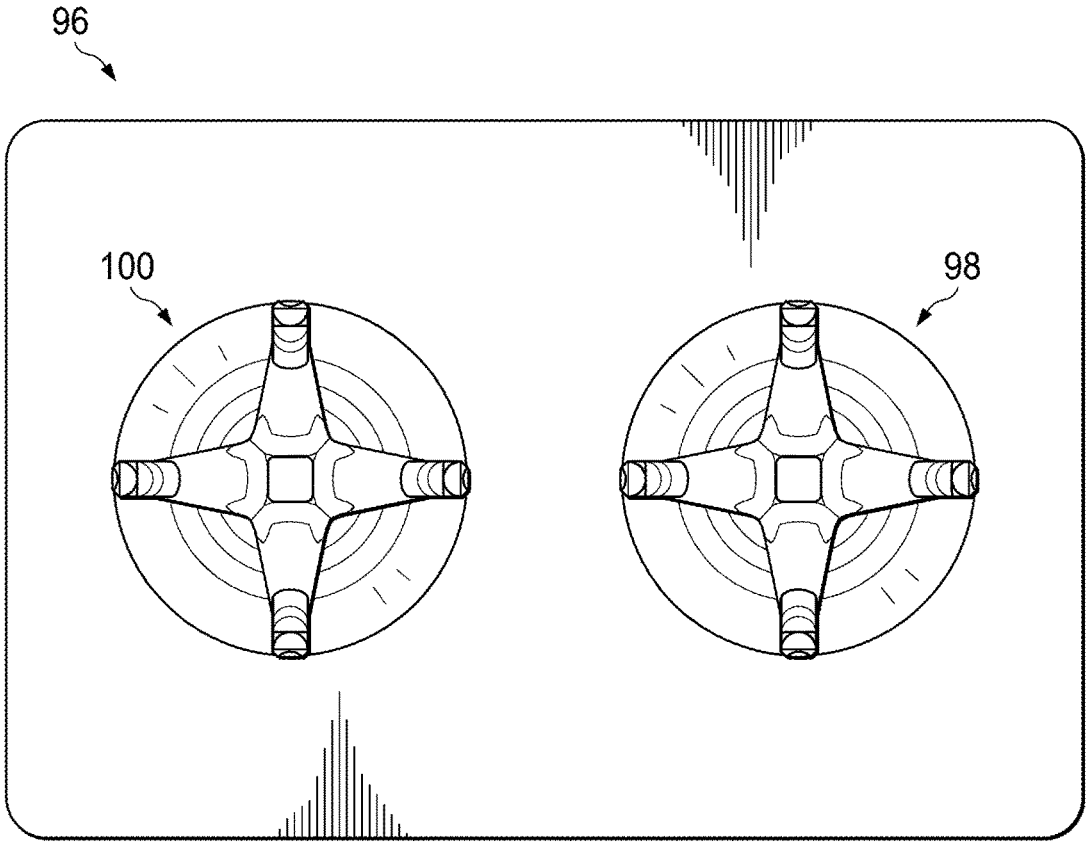

According to certain embodiments of the remote valve block 74 the suction valve may be disposed above or below the discharge valve similar to conventional reciprocating pumps with integral valve blocks. According to an alternate embodiment of a remote valve block 90 shown in FIG. 3A, the suction valve 92 may be nested in the discharge valve 94 or the discharge valve may be nested in the suction valve. According to yet another alternate embodiment of a remote valve block 96 illustrated in FIG. 3B, a suction valve 98 may be disposed beside a discharge valve 100. This embodiment differs from the valve-over-valve arrangement because the valves are disposed on the same face of the remote valve block 96. In the valve-over-valve embodiment, the valves are disposed on opposite faces of the remote valve block. Other suction and discharge valve arrangements are contemplated by this disclosure.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose.

In the specification and claims, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s), as defined solely by the appended claims. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A pumping system for delivering a working fluid into a wellbore, the pumping system comprising:

a pressure cylinder coupled to a first valve block and a second valve block;

a plunger disposed in the pressure cylinder, the plunger operable to be displaced in a suction stroke and a discharge stroke;

a packing seal disposed between the plunger and the pressure cylinder;

the first valve block and the second valve block are disposed separate from the pressure cylinder, wherein each valve block is coupled to an opposing respective end of the pressure cylinder by a respective conduit, and each valve block includes a suction valve and a discharge valve; and an isolator disposed within each respective conduit, each isolator having two opposing cup portions, and each isolator slideably engaged with a respective interior surface of each respective conduit to separate a barrier fluid from the working fluid, wherein an entirety of each isolator is freely moveable with respect to the respective interior surface of each respective conduit.

2. The pumping system of claim 1 wherein the plunger is a portion of a double-acting plunger rod.

3. The pumping system of claim 1 further comprising a hydraulic shell containing a hydraulic fluid operable to displace the plunger.

4. The pumping system of claim 1 wherein the pressure cylinder is one of a plurality of pressure cylinders formed in a cylinder block.

5. The pumping system of claim 4 wherein the plunger is one of a plurality of plungers each operable to reciprocate within a respective one of the plurality of pressure cylinders.

6. The pumping system of claim 1, wherein the barrier fluid is disposed in each respective conduit, and wherein the packing seal is exposed to the barrier fluid.

7. The pumping system of claim 6, wherein each isolator is operable to isolate the packing seal from the working fluid.

8. The pumping system of claim 7 wherein each respective conduit defines a cooling outlet port configured to communicate the barrier fluid to a fluid cooling circuit and a cooling inlet port configured to receive the barrier fluid from the fluid cooling circuit.

9. The pumping system of claim 1 wherein each of the first valve block and the second valve block comprise a first face associated with the suction valve and a second face different from the first face associated with the discharge valve.

10. The pumping system of claim 1 wherein each of the first valve block and the second valve block comprise a first face associated with both the suction valve and the discharge valve.

11. The pumping system of claim 1 wherein each respective conduit comprises a rigid pipe.

12. The pumping system of claim 11 wherein each respective conduit comprises a flexible hose.

13. A pumping system for delivering a working fluid into a wellbore, the pumping system comprising:

a pressure cylinder coupled to a first valve block and a second valve block;

a plunger disposed in the pressure cylinder, the plunger operable to be displaced in a suction stroke and a discharge stroke;

a barrier fluid disposed in the pressure cylinder;

the first valve block and the second valve block disposed separate from the pressure cylinder, wherein each valve block is coupled to an opposing respective end of the pressure cylinder by a respective conduit;

a suction valve for the working fluid disposed within each valve block;

a discharge valve for the working fluid disposed within each valve block, the working fluid being different from the barrier fluid; and an isolator disposed within each respective conduit, each isolator having two opposing cup portions, and each isolator slideably engaged with a respective interior surface of each respective conduit to separate the barrier fluid from the working fluid, wherein an entirety of each isolator is freely moveable with respect to the respective interior surface of each respective conduit.

14. The pumping system of claim 13 wherein the plunger is a portion of a double-acting plunger rod.

15. The pumping system of claim 13 further comprising a hydraulic shell containing a hydraulic fluid operable to displace the plunger.

16. The pumping system of claim 13 wherein the pressure cylinder is one of a plurality of pressure cylinders formed in a cylinder block.

17. The pumping system of claim 13 further comprising packing seals disposed between the plunger and the pressure cylinder.

18. A method for delivering a working fluid to a wellbore, comprising:

displacing a plunger through a packing seal and within a pressure cylinder in a first direction, the pressure cylinder coupled to a first valve block and a second valve block, wherein each valve block is coupled to an opposing respective end of the pressure cylinder by a respective conduit, and each valve block includes a suction valve and a discharge valve;

drawing the working fluid through the suction valve and into the respective conduit, the suction valve being disposed in the first valve block;

displacing the plunger through the packing seal within the pressure cylinder in a second direction opposite the first direction;

discharging the working fluid from the respective conduit through the discharge valve disposed in the first valve block; and displacing an isolator within each respective conduit, each isolator having two opposing cup portions, and each isolator slideably engaged with a respective interior surface of each respective conduit to separate a barrier fluid from the working fluid, wherein an entirety of each isolator is freely moveable with respect to the respective interior surface of each respective conduit.

19. The method of claim 18 further comprising pressurizing the barrier fluid disposed within each respective conduit.

20. The method of claim 19, each isolator being disposed between the barrier fluid and the working fluid.

* * * * *